US006557320B2

(12) United States Patent
Chang et al.

(10) Patent No.: US 6,557,320 B2
(45) Date of Patent: May 6, 2003

(54) COMPACT DISK PACKING MACHINE

(76) Inventors: Chen Hsien Chang, 3F, No. 5, Ai Shin I Street, Ta Li City, Taichung Hsien (TW); Chia Wen Liu, 3F, No. 326, Yung Hsing Road, Ta Li City, Taichung Hsien (TW); Mao Lung Chien, No. 6, Dong Guang Yuan Road, East Zone, Taichung (TW); Ching Chuan Kuo, 7F-2, No. 1846, Chien Cheng Road, Taichung City (TW)

( * ) Notice: Subject to any disclaimer, the term of this patent is extended or adjusted under 35 U.S.C. 154(b) by 0 days.

(21) Appl. No.: 09/943,317

(22) Filed: Aug. 31, 2001

(65) Prior Publication Data

US 2003/0041558 A1 Mar. 6, 2003

(51) Int. Cl.[7] ..... B65B 5/06; B65B 5/10

(52) U.S. Cl. ..... 53/157; 53/155; 53/266.1; 53/238; 53/254; 53/284.5; 53/381.1

(58) Field of Search ..... 53/157, 473, 474, 53/237, 240, 457, 443, 266.1, 445, 468, 155, 238, 254, 284.5, 382.1, 381.1

(56) References Cited

U.S. PATENT DOCUMENTS 4,605,393 A * 8/1986 Krieger et al. ..... 271/95
4,685,277 A * 8/1987 Ilsemann ..... 123/396
4,854,930 A * 8/1989 Miselli et al. ..... 493/315
5,102,385 A * 4/1992 Calvert ..... 493/315
5,603,599 A * 2/1997 Wesslen et al. ..... 294/64.2
5,816,028 A * 10/1998 Zaniboni ..... 53/238
5,844,593 A * 12/1998 Proffitt et al. ..... 347/262
5,997,458 A * 12/1999 Guttinger et al. ..... 271/108
6,035,605 A * 3/2000 Perego ..... 53/117
6,367,231 B1 * 4/2002 Yamamoto ..... 53/266.1
6,397,564 B1 * 6/2002 Yamamoto ..... 53/157
6,418,703 B1 * 7/2002 Yamamoto ..... 53/473

* cited by examiner

*Primary Examiner*—Rinaldi I. Rada
*Assistant Examiner*—Gloria R Weeks
(74) *Attorney, Agent, or Firm*—Charles E. Baxley

(57) ABSTRACT

A the compact disk packing machine includes a base having a box providing device for move empty boxes to a box opening device which opens the empty boxes one by one. A transferring device transfers the opened boxes to a disk providing device and a disk positioning device to put a compact disk in each of the opening boxes. A sheet putting device puts a sheet of commercial in the open boxes and a closing device closes the boxes. The boxes having a compact disk and a sheet of commercial are transferred to a collection device and piled up.

1 Claim, 8 Drawing Sheets

COMPACT DISK PACKING MACHINE

FIELD OF THE INVENTION

The present invention relates to a compact disk packing machine that automatically puts a compact disk and a sheet of commercial in a box.

BACKGROUND OF THE INVENTION

Compact disks are used in a variety of fields such as video games, software, and audio and video films. All of these are stored in a compact disk and sold by receiving the compact disk in a box. A commercial sheet is put in the box so that the customers know the detail information in the compact disk to be bought. There are involved many processes to pack the compact disk and the commercial sheet in the box which generally includes a base and a cover.

SUMMARY OF THE INVENTION

In accordance with one aspect of the present invention, there is provided a buckle device for luggage and comprising.

The primary object of the present invention is to provide a machine that is able to open the box, put the compact disk and the commercial sheet in the box and close the box by several continuous processes.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
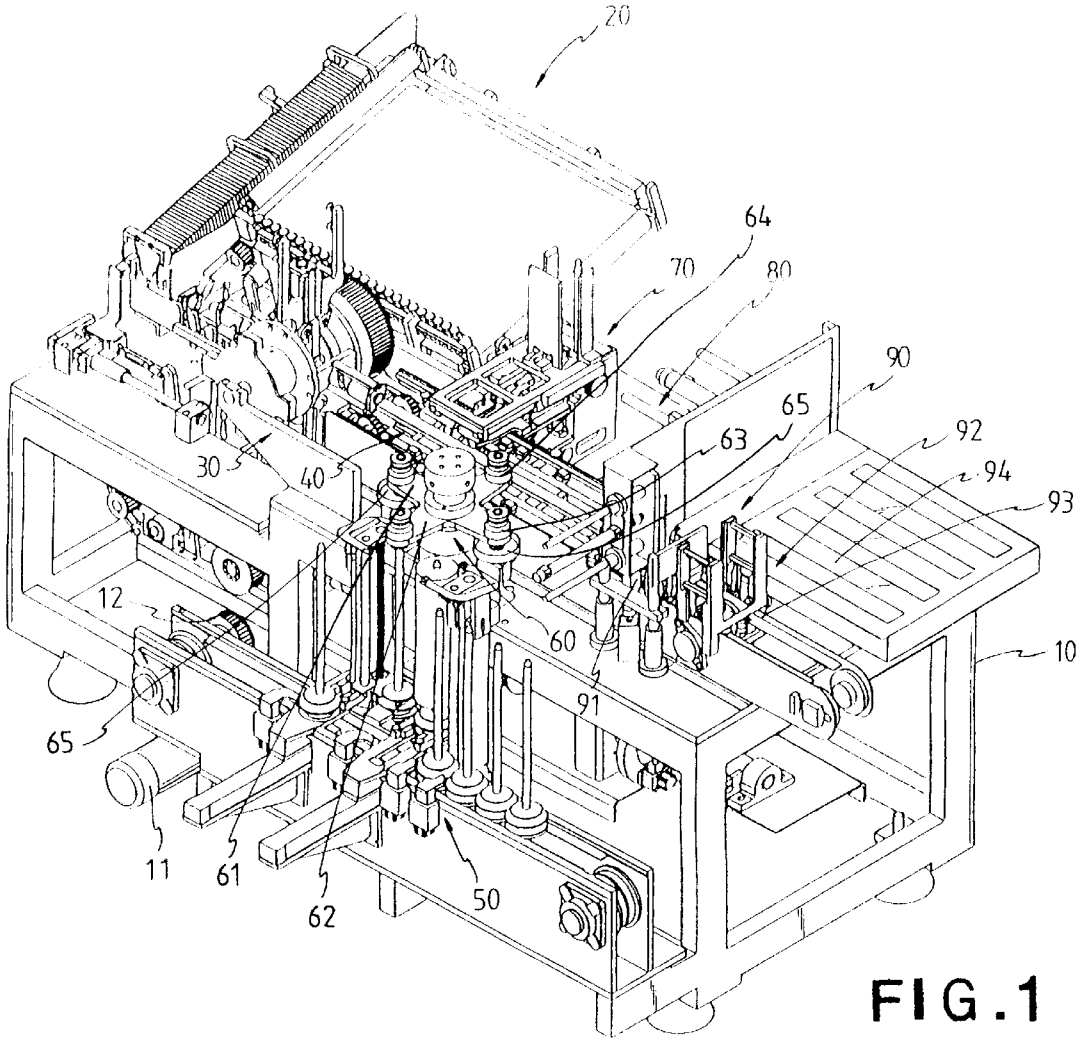
FIG. 1 is a perspective view to show the compact disk packing machine of the present invention.

Referring to FIGS. 1 to 8, the compact disk packing machine of the present invention comprises a base 10, a box providing device 20, a box opening device 30, a transferring device 40, a disk providing device 50, a disk positioning device 60, a sheet putting device 70, a closing device 80, and a collection device 90.

Figure 2:
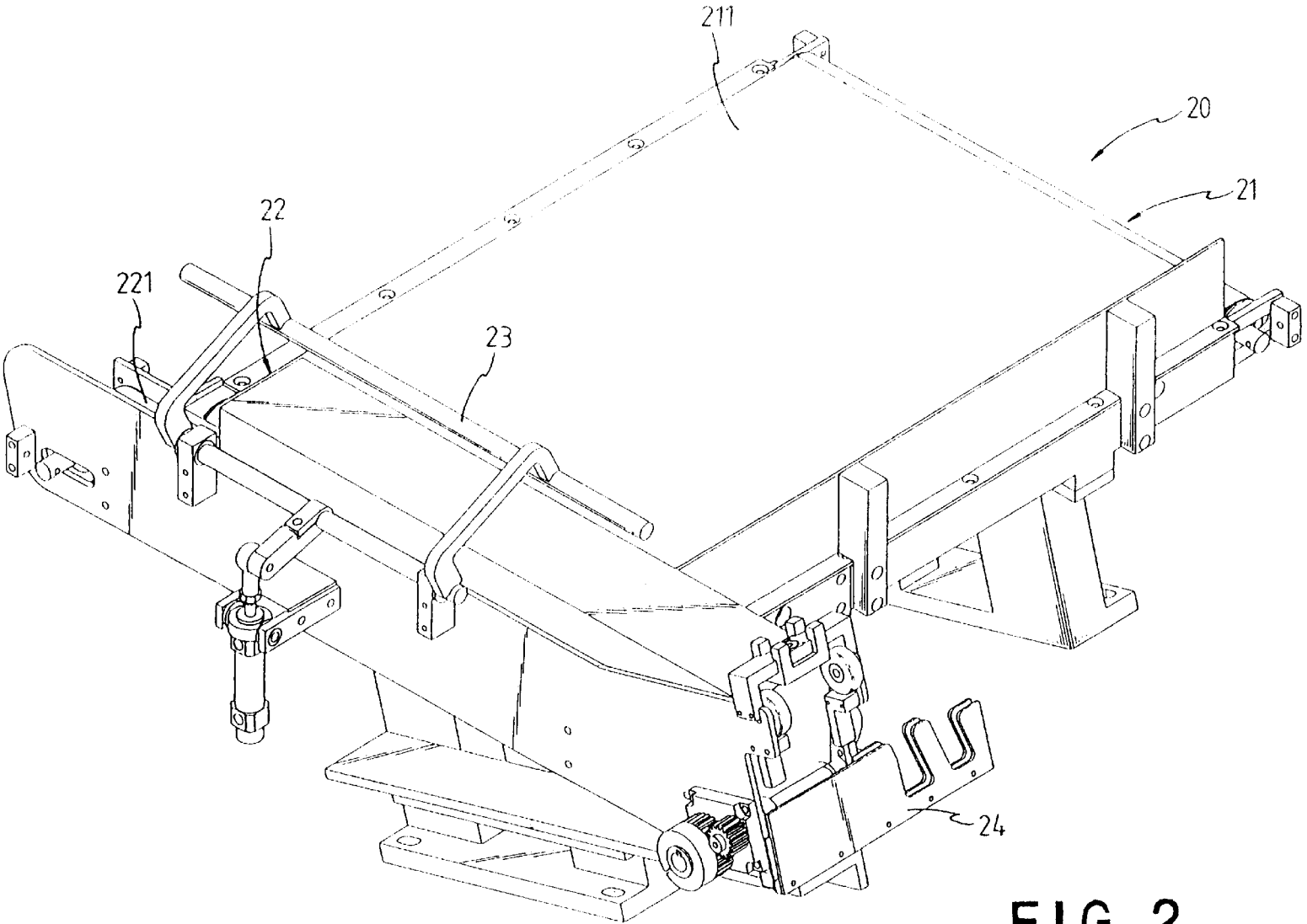
FIG. 2 is a perspective view to show a box providing device of the compact disk packing machine of the present invention.

The base 10 has parts such as the motor 11, belts, wheels 12 and links to be installed therein. The box providing device 20 is located beside the base 10 and has a stack portion 21 for collecting the empty boxes and a providing portion 22 is used to provide the empty box one by one. The stack portion 21 includes a large area for the empty boxes to be arranged in the area and a transferring surface 211 is mounted on the stack portion 21 so as to send the boxes transverse to the longitudinal axis of the stack portion 21. Therefore, when the boxes are arranged in the stack portion 21, they can be moved in the transverse direction by the transferring surface 211. The providing portion 22 is located beside the stack portion 21 and a transferring belt 221 is connected to the providing device 22 so that the boxes can be moved in a longitudinal direction after the boxes in the stack portion 21 are sent to the providing portion 22. A driving member 221 is connected to the providing device 22 so as to individually dispense the empty boxes. A separation bar 23 is located between the stack portion 21 and the providing portion 22 so as to properly separate the stack portion 21 and the providing portion 22. A V-shaped rack 24 as shown in FIG. 2 is connected to a side of the providing portion 22 so as to position the empty boxes dispensed from the providing portion 22.

Figure 3:
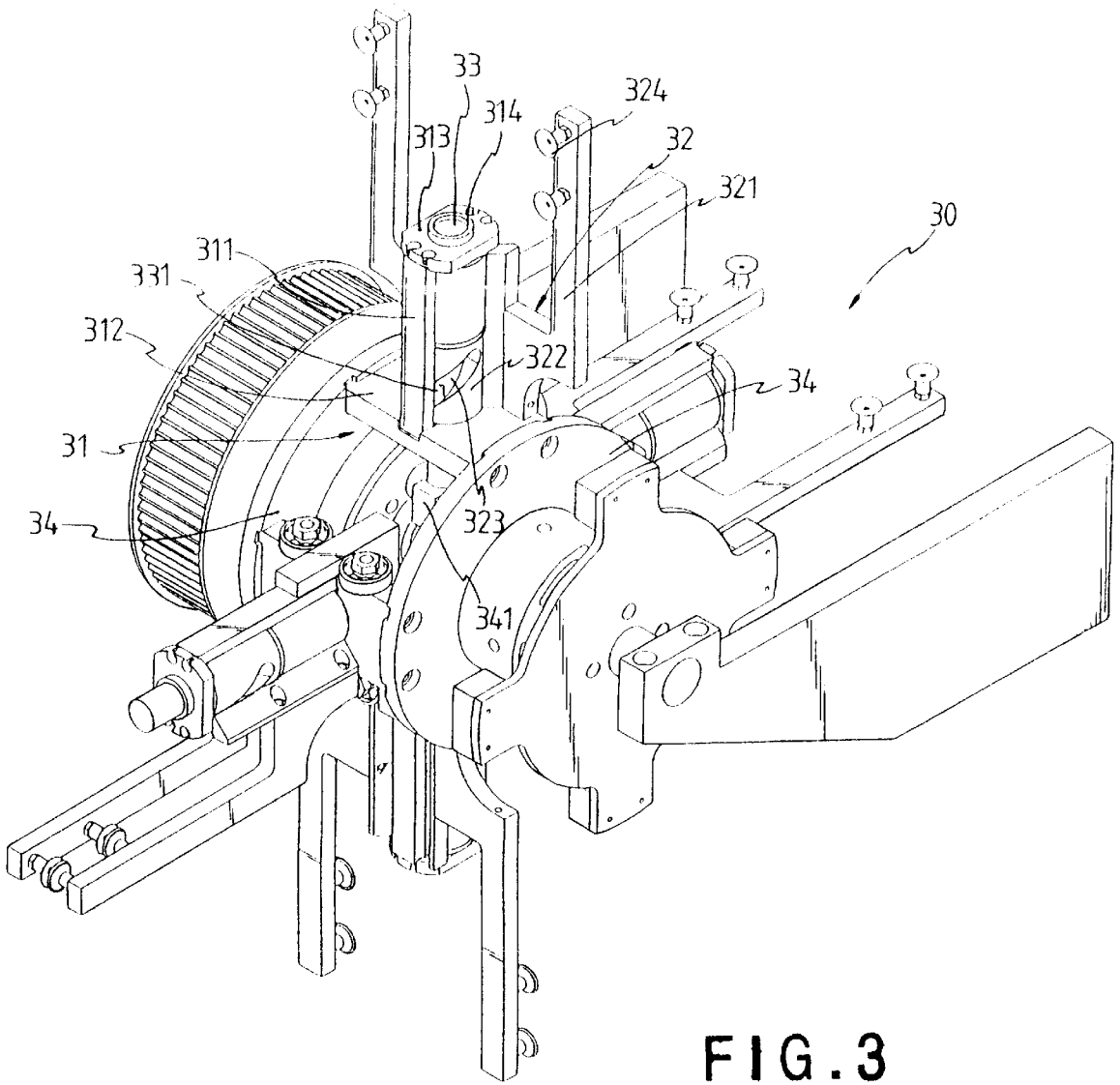
FIG. 3 is a perspective view to show a box opening device of the compact disk packing machine of the present invention.
Figure 4:
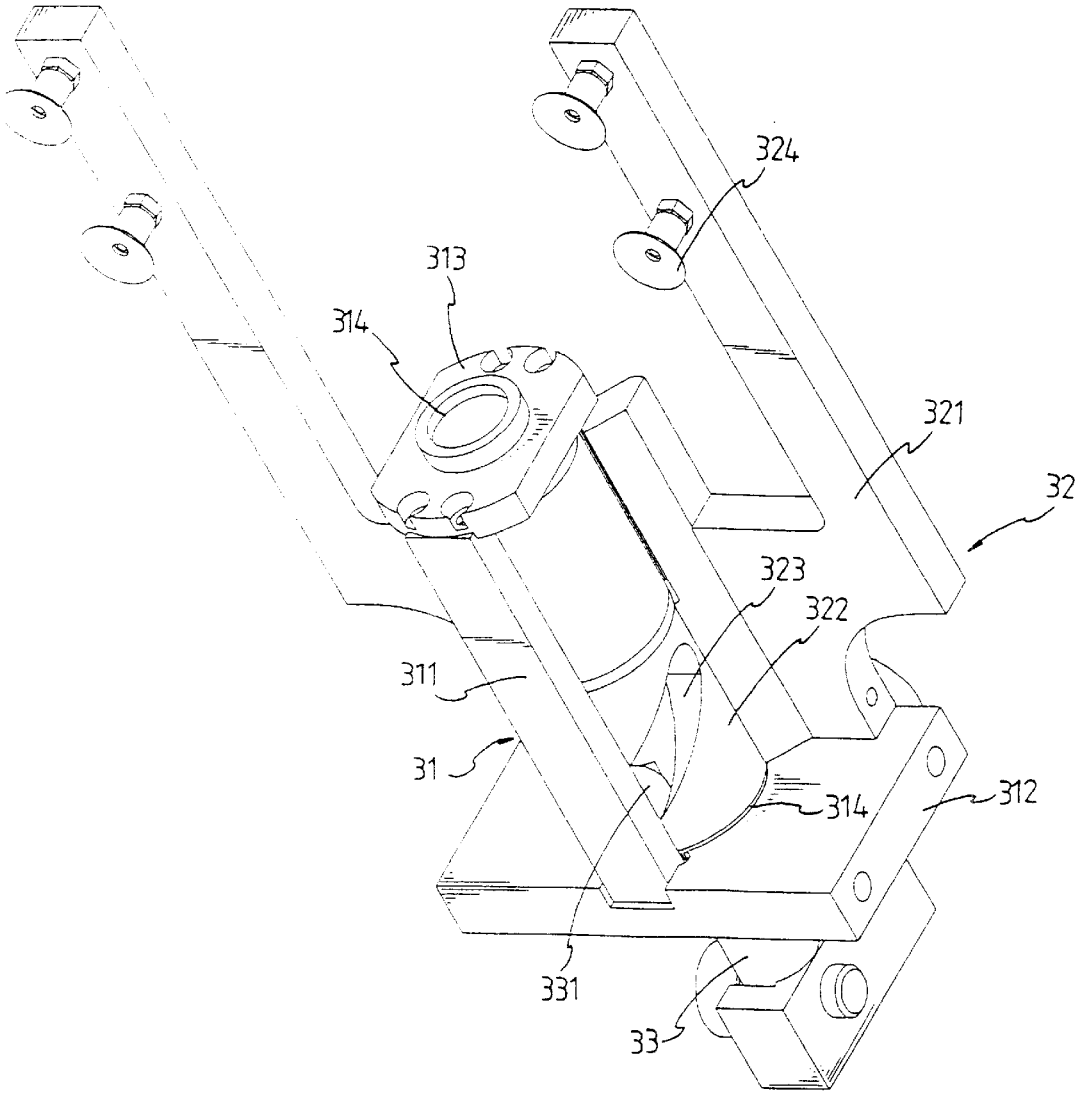
FIG. 4 is a perspective view to show a set of opening means of the box opening device of the compact disk packing machine of the present invention.

As shown in FIGS. 3 and 4, the box opening device 30 is located beside the box providing device 20 and is used to open the empty boxes provided by the box providing device 20. As shown in FIGS. 3 and 4, the box opening device 30 includes a base frame 31, opening arms 32, activation rods 33 and a rotary set 34. The base frame 31 has two arms 311, and a base portion 312 and a connection portion 313 are respectively connected to two ends of the arms 311. Each of the base portion 312 and the connection portion 313 has a hole 314. The connection portion 313 is connected to the base frame 10. The opening arms 32 has an action portion 321 and a sleeve portion 322 through which a driving hole 323 is defined. The action portion 321 has sucking members 324. A shaft 33 extends through the holes 314 in the base portion 312 and the connection portion 313 and the sleeve 322. A slide member 331 is connected to the shaft 33 and located corresponding to the driving hole 323 of the opening arms 32. When the shaft 33 moves reciprocatingly, the slide member 331 moves in the driving hole 323 and drives the opening arms 32 to move toward with each other and away from each other. A plurality of the box. opening devices 30 are connected to the rotary set 34 so as to open the boxes continuously. A cam 341 on the rotary set 34 drives the shaft 33 so as to activate the chosen box opening device 30.

The transferring device 40 is located followed by the box opening device 30 so as to deliver the opened boxes.

Figure 5:
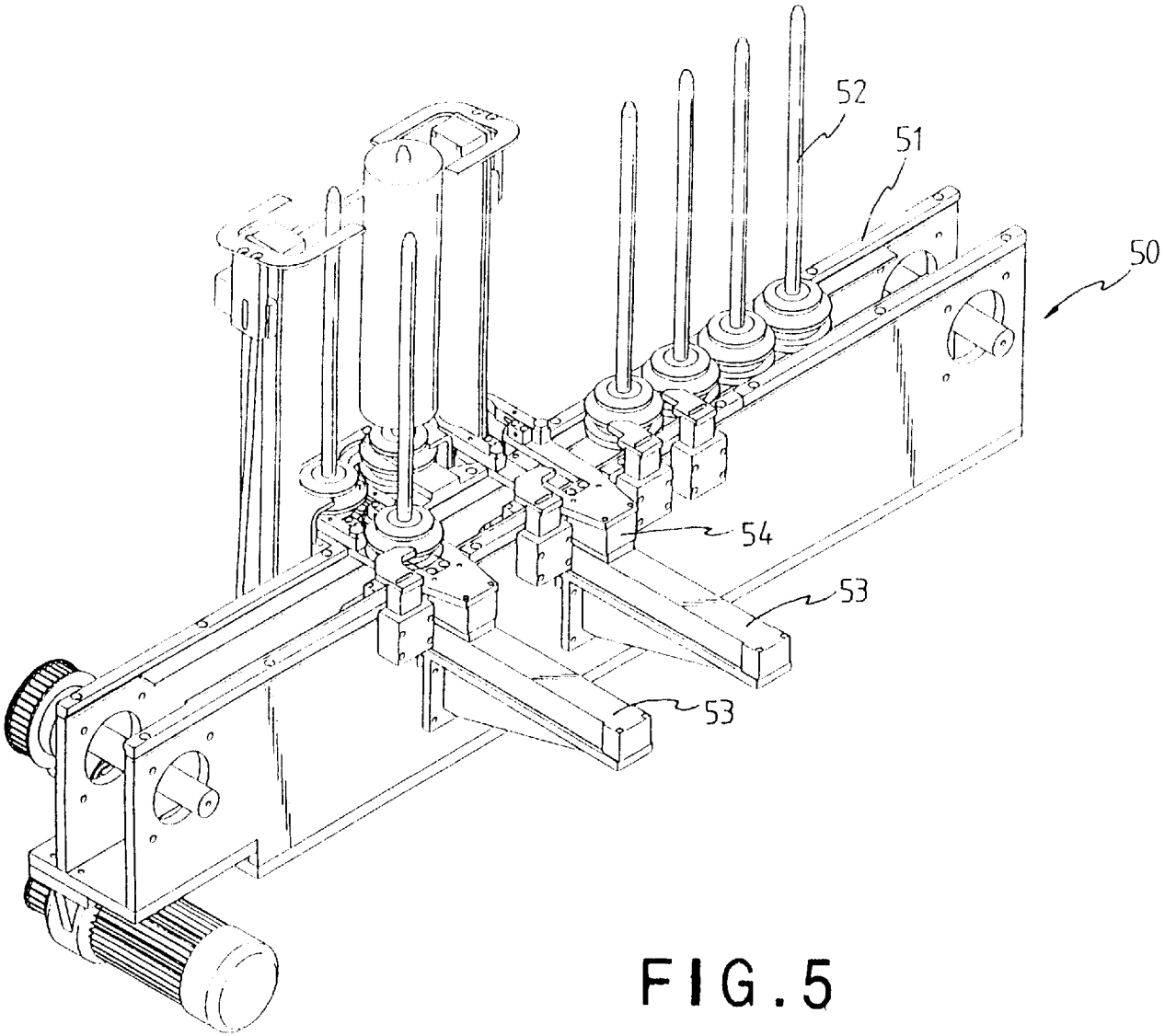
FIG. 5 is a perspective view to show a compact disk providing device the compact disk packing machine of the present invention.

As shown in FIG. 5, the disk providing device 50 is located on a side of the base frame 10 and has a plurality of rods 52 on rails 51 and the rods 52 are movable on the rails 51. The compact disks are piled on the rods 52. Two exchange rails 53 and two exchange arms 54 are located beside the rails 51. The exchange arms 54 clamp and exchange the rods 52 with compact disks mounted thereon and the rods 52 without compact disks mounted thereon.

The disk positioning device 60 is located between the transferring device 40 and the disk providing device 50. Four picking members 61, 62, 63 and 64 are connected to the disk positioning device 60 and each of which has a sucking member to pick up the compact disks. The disk positioning device 60 can be operated at 90 degrees and moves forward and backward. Two 61, 62 of the picking members 61–64 pick disks in the forward stroke from the disk providing device 50, and put the picked disks on the stand-by positions 65 in the backward stroke. The other two picking members 63, 64 pick the disks from the stand-by positions 65 in the forward stroke and put the disks in the boxes in the backward stroke.

Figure 6:
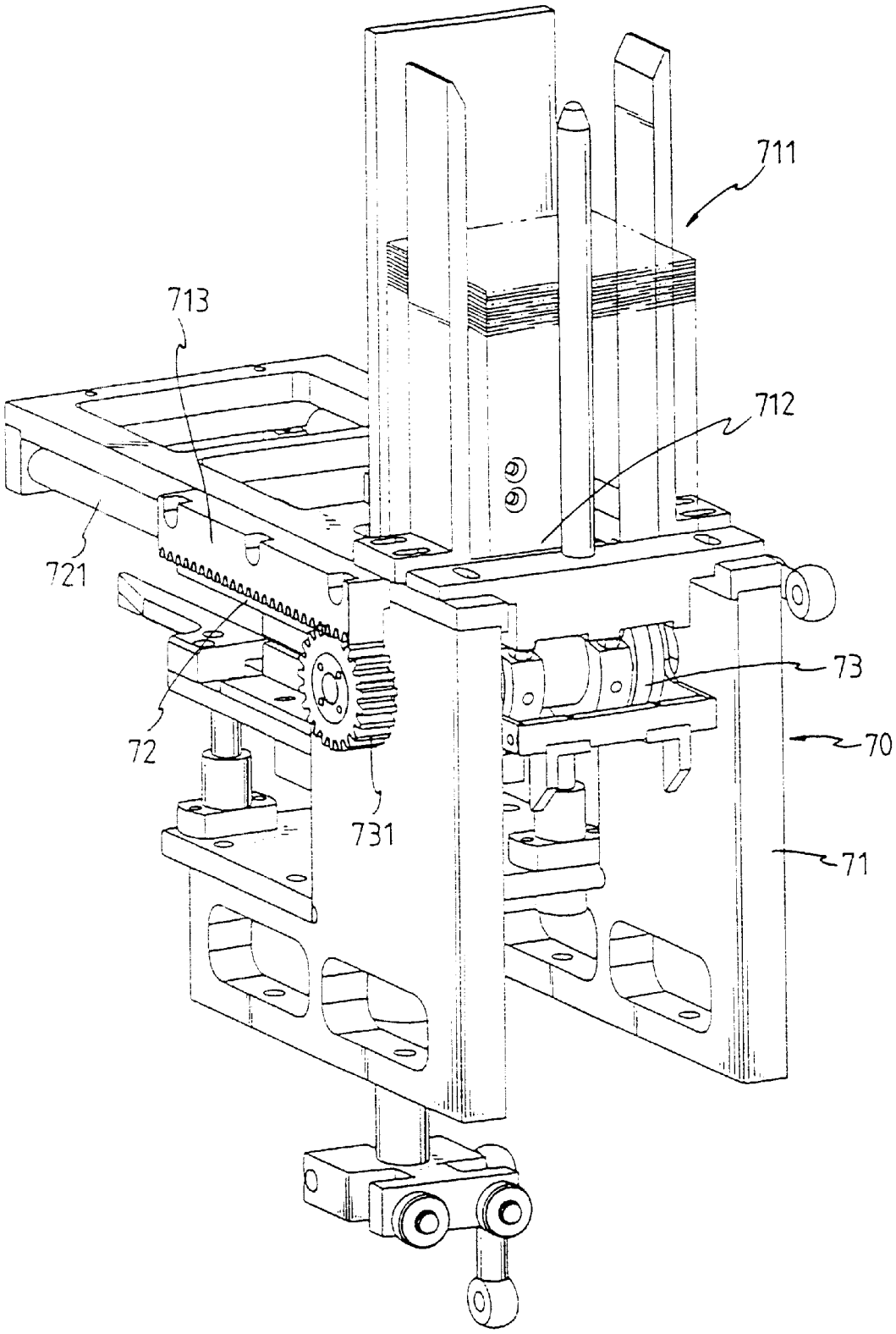
FIG. 6 is a perspective view to show a commercial sheet providing device of the compact disk packing machine of the present invention.
Figure 7:
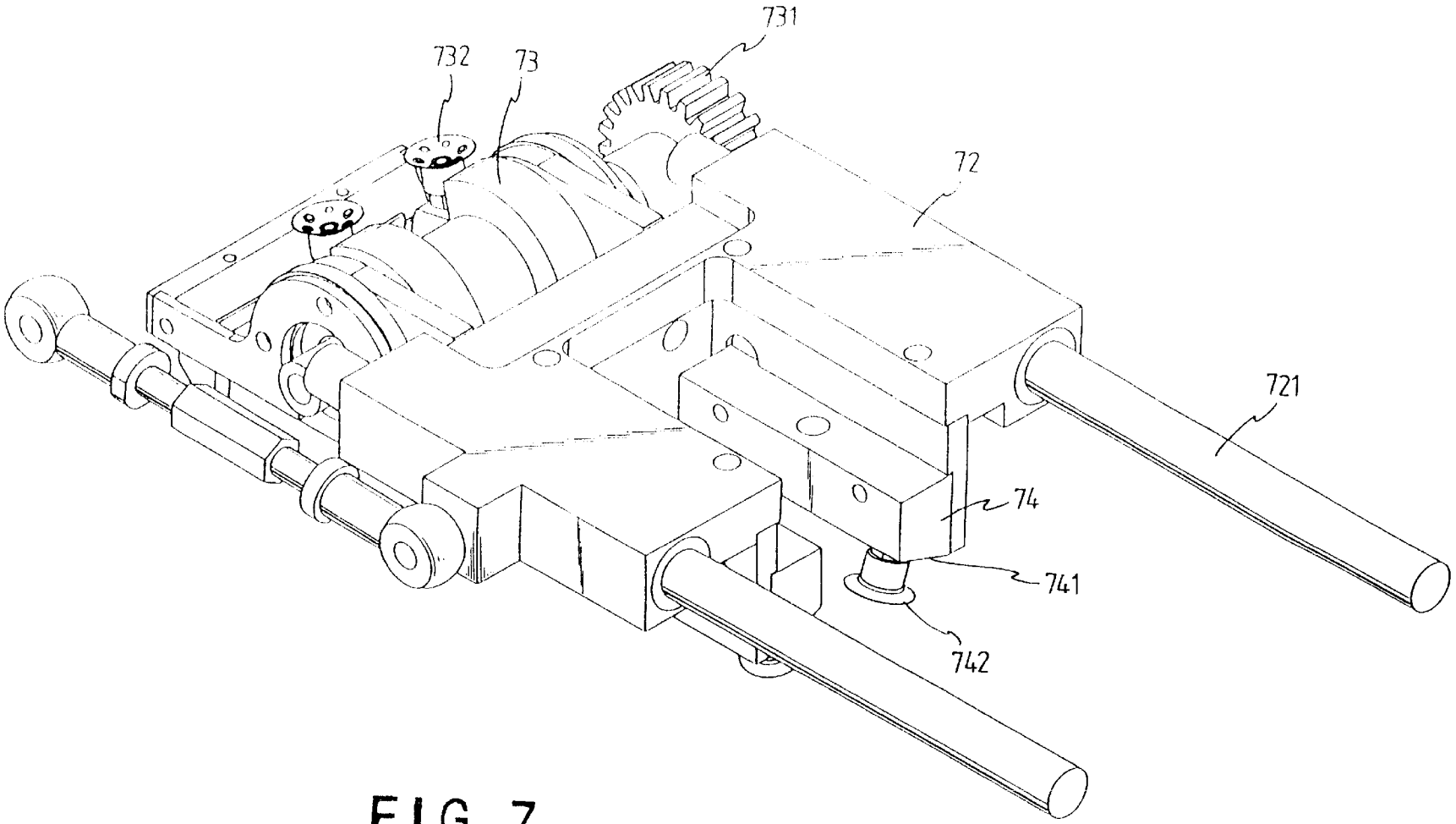
FIG. 7 is a perspective view to show a sliding frame in the commercial sheet providing device of the compact disk packing machine of the present invention.
Figure 8:
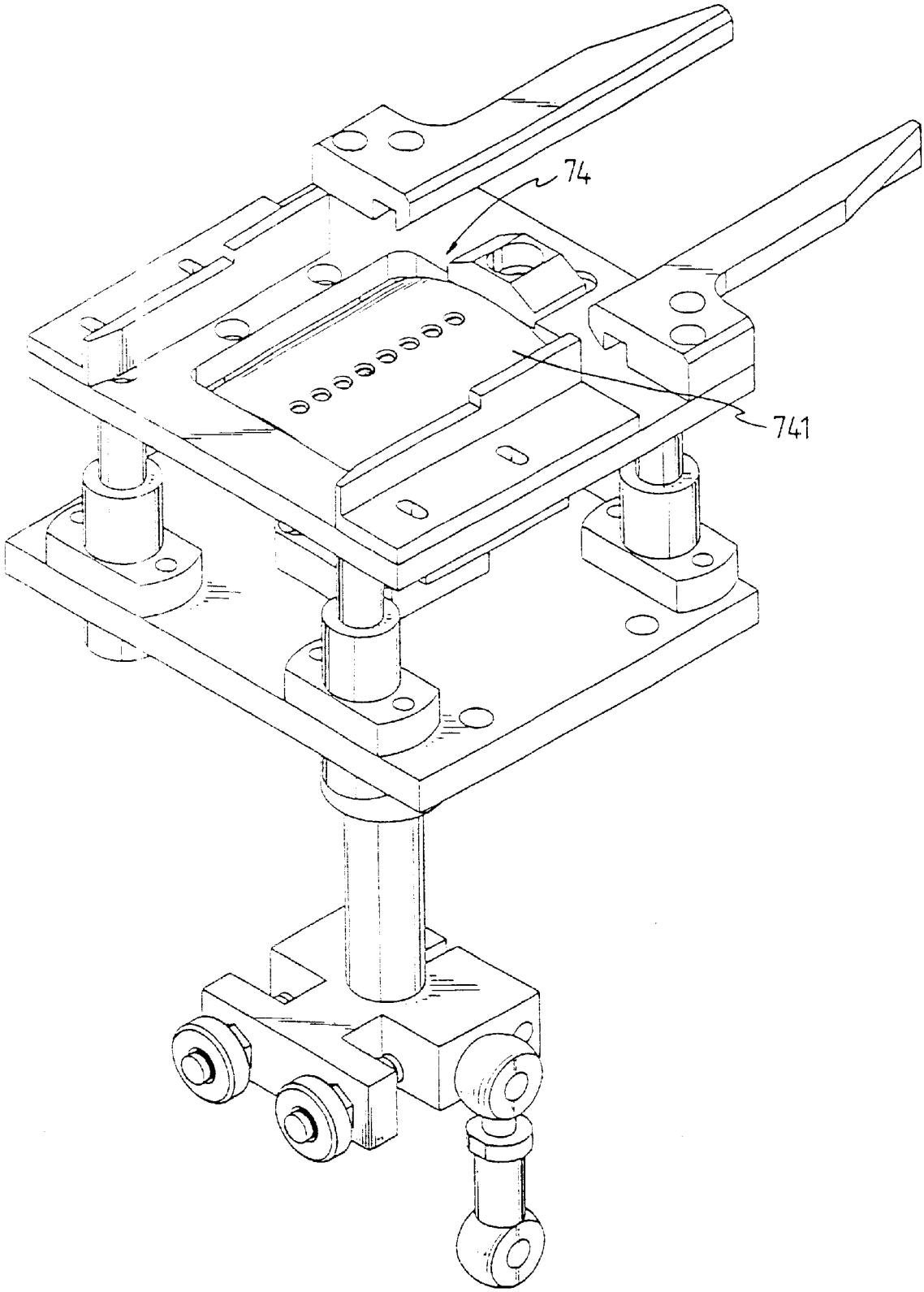
FIG. 8 is a perspective view to show a transfer device in the commercial sheet providing device of the compact disk packing machine of the present invention.

As shown in FIGS. 6 and 7, the sheet putting device 70 includes a base frame 71, a slide frame 72, a sheet picking wheel 73, a transfer member 74 and a sheet putting means 75. The base frame 71 has a setting portion 711 so that the sheets are piled in the setting portion 711 and an opening 712 is defined in a lower end of the setting portion 711 so that the sheets can be dispensed from the opening. A rack 713 is located beside the base frame 71. The slide frame 72 is located corresponding to the opening 712 and is connected to the base frame 71 by the slide rods 721 so that the slide frame 72 can be slid on the slide rods 721. The sheet picking wheel 73 is pivotally connected to the end of the slide frame 72. A gear 731 is connected to the base frame 71 and is engaged with the rack 712. Two sucking members 732 are connected to the sheet picking wheel 73 so as to suck a sheet from the opening 712. The transfer member 74 is moved upward or downward, and has a transfer surface 741 in which sucking apertures 741 are defined so as to suck sheets on the sheet picking wheel 73 via the transfer surface 741. The sheet putting means 75 has two inward surfaces 751 on which sucking members 752 are connected. The sheet picking wheel 73 is rotated by the slide frame 72 and the sheets are sucked and transferred to the sheet putting means 75. The sheets are sucked by the sucking members 752 on the sheet putting means 75 and transferred by the slide frame 72 so as to be put in the boxes.

The closing device 80 is composed of swiping arms and gear sets so that when the gear sets activate the swiping arms to close the boxes.

The collection device 90 collects the boxes having a compact disk and the sheet received therein. Two sensors are used to check the sheets or the compact disks in the boxes, and the boxes are then pushed by a pushing rod 91 to be piled up and transferred to a collection surface 94. The boxes that are checked to be lack of the compact disk or the sheet are collected by the pushing rods 91 to a pre-decided position.

The machine of the present invention automatically opens the boxes and put the disk and the sheet in each of the boxes, the packed boxes are then collected. All the processes are automatically operated which meets the requirements of the industry.

While we have shown and described the embodiment in accordance with the present invention, it should be clear to those skilled in the art that further embodiments may be made without departing from the scope of the present invention.

What is claimed is:

1. A compact disk-packing machine comprising:

a base (10) having a box providing device (20) located beside the base (10), the base (10) having a stack portion (21) which is adapted to collect empty boxes, and a providing portion (22) which is used to provide the empty box one by one;

a plurality of box opening devices (30) connected to a periphery of a rotary set (34) and each including a base frame (31), opening arms (32) and activation rods (33), the base frame (31) having two arms (311), a base portion (312) and a connection portion (313) respectively connected to two ends of the arms (311), the connection portion (313) connected to the base frame (10), the opening arms (32) having an action portion (321) and a sleeve portion (322), a driving hole (323) defined a wall of the sleeve portion (322), the action portion (321) having sucking members (324), a shaft (33) extending through holes (314) defined in the base portion (312) and the connection portion (313) and the sleeve (322), a slide member (331) connected to the shaft (33) and located corresponding to the driving hole (323) of the opening arms (32), when the shaft (33) moves reciprocatingly, the slide member (331) moves in the driving hole (323) and drives the opening arms (32) to move toward with each other and away from each other;

a disk providing device (50) located on a side of the base frame (10) and having a plurality of rods (52) movably installed on rails (51), two exchange rails (53) and two exchange arms (54) located beside the rails (51);

a disk positioning device (60) having four picking members (61, 62, 63 and 64) and each of the picking members having a sucking member;

a sheet putting device (70) including a base frame (71), a slide frame (72), a sheet picking wheel (73), a transfer member (74) and a sheet putting means (75), the base frame (71) having a setting portion (711) for sheets piled in the setting portion (711), an opening (712) defined in a lower end of the setting portion (711) for dispensing the sheets, a rack (713) located beside the base frame (71), the slide frame (72) located corresponding to the opening (712) and connected to the base frame (71) by the slide rods (721) so that the slide frame (72) can be slid on the slide rods (721), the sheet picking wheel (73) pivotally connected to the end of the slide frame (72), a gear (731) connected to the base frame (71) and engaged with the rack (712), two sucking members (732) connected to the sheet picking wheel (73), the transfer member (74) having a transfer surface (741) in which sucking apertures (741) are defined, a sheet putting means (75) having two inward surfaces (751) on which sucking members (752) are connected;

a closing device (80) having swiping arms and gear sets so that when the gear sets activate the swiping arms, the swiping arms being adapted to close the boxes, and a collection device (90) having two sensors and adapted to push the boxes by a pushing rod.

* * * * *